US007326163B2

(12) United States Patent
Hughes et al.

(10) Patent No.: US 7,326,163 B2
(45) Date of Patent: Feb. 5, 2008

(54) PRESSURE PAD FOR CLOSING BOTTOM OF CARTON

(75) Inventors: Tim P. Hughes, Cedar Rapids, IA (US); Kimberly D. Ammons, Cedar Rapids, IA (US)

(73) Assignee: Evergreen Packaging Inc., Memphis, TN (US)

( * ) Notice: Subject to any disclaimer, the term of this patent is extended or adjusted under 35 U.S.C. 154(b) by 0 days.

(21) Appl. No.: 11/363,879

(22) Filed: Feb. 28, 2006

(65) Prior Publication Data

US 2007/0203006 A1 Aug. 30, 2007

(51) Int. Cl.
*B31B 1/28* (2006.01)

(52) U.S. Cl. ..... 493/165; 493/141; 493/184; 53/477; 53/565; 53/563

(58) Field of Classification Search ..... 493/165, 493/963, 141, 184; 53/477, 374.2, 565, 563, 53/DIG. 2; 156/581
See application file for complete search history.

(56) References Cited

U.S. PATENT DOCUMENTS 3,971,300 A * 7/1976 Bachner ..... 493/133
4,011,800 A * 3/1977 Walke ..... 493/133
4,192,446 A 3/1980 Naito
4,540,116 A 9/1985 Shirakawa
4,667,873 A 5/1987 Yasui et al.
4,702,410 A 10/1987 Derving
4,713,181 A * 12/1987 Russell ..... 210/776
4,761,156 A * 8/1988 Bachner et al. ..... 493/133
5,135,463 A * 8/1992 Hyduk ..... 493/133
5,482,204 A 1/1996 Mills et al.
5,588,943 A 12/1996 Mills et al.
5,683,339 A 11/1997 Mills et al.
5,762,595 A * 6/1998 Santiago et al. ..... 493/133
6,260,333 B1 * 7/2001 Stamm ..... 53/477
6,315,705 B1 * 11/2001 Eichinger et al. ..... 493/141
6,599,225 B2 7/2003 Ammons et al.

* cited by examiner

*Primary Examiner*—Hemant M. Desai
(74) *Attorney, Agent, or Firm*—Daniel F. Nesbitt; Donald E. Hasse; Hasse & Nesbitt LLC

(57) ABSTRACT

Pressure pads useful in the closing and sealing of multiple components which define the bottom of a carton, particularly a gable-type carton, bottom having a square or rectangular footprint. The invention is especially useful in the closing of the bottom of cartons wherein the sealing fin of the carton bottom is non-handed.

9 Claims, 4 Drawing Sheets

PRESSURE PAD FOR CLOSING BOTTOM OF CARTON

FIELD OF INVENTION

This invention relates to pressure pads useful in the closing and sealing of multiple components which define the bottom of a carton, particularly a gable-type carton, bottom having a square or rectangular footprint. The invention is especially useful in the closing of the bottom of cartons wherein the sealing fin of the carton bottom is non-handed.

BACKGROUND OF INVENTION

U.S. Pat. No. 6,599,225, incorporated herein in its entirely by reference, discloses a relatively recently designed carton for the packaging of liquids and/or other pourable materials. This carton is of the gable-top variety and includes a pour spout affixed to one of the two major inclined panels which define the closed top end of the carton. The advent of this use of pour spouts on one of the major top panels of the carton introduced a production dilemma, namely, the presence of the pour spout rendered the new carton "handed". That is, the carton assumed either "left handedness" or "right handedness" with respect to the movement of the carton through a "form, fill and seal" packaging machine. Whereas it was possible with non-handed gable-top cartons to increase the overall output of a given packaging machine by merely adding to the existing machine a second line of production. The advent of the pour spout, such mere duplication of the first production line with a second production line was made impossible by reason of the need for a pour spout (at times referred to as a "fitment") attachment and heat sealing apparatus to be added to the machine laterally of the production line, ie. projecting perpendicular to the direction of movement of cartons through the machine. The required positioning of this fitment attachment apparatus dictated that the hole in the top panel of the carton into which the fitment was to be inserted and sealed had to face laterally outwardly of the direction of movement of the production line. To add a second production line required a second fitment attachment apparatus, but because the hole into which the fitment was to be inserted and sealed had to face outwardly of the second production line, the cartons moving along the second line were rotated 180 degrees (ie., flipped over front to back) relative to the orientation of the cartons moving along the first line. This situation prevented the common use by both the first and second lines of certain common components of the production machine, thereby negating the prior ability to gain productivity by doubling the production lines. In particular, it became impossible to close the bottom of the carton using a single pressure pad as had been possible prior to the advent of the addition of a pour spout on the top end of the carton.

As is well known in the art, the sealing of the bottom end of a paperboard laminate-based carton requires that the erected carton be fitted over a mandrel having a distal end carrying a pressure pad. Thereafter, the several folds required to shape various flaps, tabs and panels into a flat bottom closure for the carton must be brought into their respective overlying relationships. While held in such relationships, the flaps, tabs and panels are heated to effect a sealing of these several folded flaps, tabs and panels to one another in a manner which precludes leakage (particularly of liquids, gases and/or flavours) into or out of the finished carton. In some such combinations of infolding and overlaying of the bottom-forming flaps and panels of the carton, there exists multiple layering of the paperboard laminate, severe bending of the laminate at the folds, and particularly at corners of folds, etc. In the prior art, the problem of sealing of the bottom-forming flaps and panels of the carton has been approached through the addition of more sealing polymeric material to the facing surfaces of the folded laminate, skiving the outboard edges of certain of the flaps or panels to minimize the overall thickness of the folds at various locations over the bottom of the carton, altering the folding pattern of the flaps and/or panels, and other measures intended to enhance the sealability of the bottom-forming components.

One approach to the multiple production line concept has been to provide a "non-handed" sealing fin for the bottom of the carton, thereby allowing the use of a single pressure pad for both the first and second production lines. This general concept has proven effective for use with cartons intended to be used for packaging of milk, juices, and similar food-type liquids. However, problems have been found when this prior concept has been employed for forming the bottoms of cartons which are intended to be filled with certain other products, such as cooking oil, for example.

U.S. Pat. No. 6,599,225 depicts one embodiment of a blank for a carton having a square or rectangular footprint, the bottom end of which includes panels and flaps which, when infolded toward the central axis of the erected carton, form a closure for the bottom end of the carton and which includes a "non-handed" sealing fin. With respect to the bottom closure of the depicted carton blank, it is noted that the blank depicted in this patent is divided by vertical fold lines into first, second, third, fourth and fifth vertical side panels. When erected, this flank forms a tube of rectangular or square cross-section, the first, second, third and fourth panels defining the four sides of an erected carton. A relatively narrow fifth side panel is employed as a side sealing panel to close the tubular shape of the erected carton.

Closing of the bottom end of the tubular carton, prior to filling the carton, is accomplished by the cooperative infolding of major end panels, flaps and tabs which are integrally formed with respective ones of the bottom ends of respective ones of the first-fourth side panels and the fifth panel which serves as a glue panel for retaining the first-forth side panels in their tubular-forming relationship. Each of the first-fourth major bottom panels includes an integrally formed minor bottom panel appended to the outboard side edge thereof. Concomitantly with the infolding of the major bottom panels, the bottom closing operation further folds the second and third minor bottom panels along angular score lines and of the second major bottom panel and angular score lines of the fourth major bottom panel to define triangular gussets on each of the second fourth sides of the erected carton. The apices of these gussets meet and/or partially overlap at the center of the bottom of the carton creating a multilayered grouping of the bottom panels adjacent the center of the carton bottom. Sealing of this multi-layered grouping of the gussets' apices, it will be recognized that folding of the carton material (commonly laminated paperboard), imparts severe stress to the carton material along the fold lines and particularly at the apex of each gusset, with attendant tendency for the carton material to delaminate, crack or otherwise lose its integrity.

Completion of the sealing of the bottom of the carton is effected by means of seal fin panels which are integrally formed along the outboard edges of the first and second major bottom panels. As the gussets are formed in the course of infolding of the major and minor bottom panels, these seal fin panels move into overlying registration with one another and eventually their overlying faces are heat sealed to one another. Thereupon the fin seal so formed is folded back into overlying relationship with one of the major bottom panels. Being "non-handed", the seal fin acceptably may be folded back upon a selected one of either that major panel which is located on the same carton side as the location of the pour spout or folded back over the other of the two major panels. (See FIG. 12 of U.S. Pat. No. 6,599,225 which depicts left-handedness or right-handedness of the erected carton).

Efforts to minimize the deleterious effects of the infolding of the major and minor panels which define closure of the bottom of an erected carton have included cutting away a portion of the blank between the opposite ends of the first fin panel at the ends of their adjacent second minor panels and between the end of the second fin panel and the end of its adjacent third minor bottom panel. Also, terminating the second fin panel short of the fifth glue panel has been practiced. All of these measures attempted to minimize folding stresses and overlapping of layers of the carton material. Moreover, the outer edges of the fin panels have been tapered in a direction away from their respective center fold lines to enhance parallelity of folding of these minor panels.

Irrespective of these and other measures of like nature, effective sealing of gable-top type cartons having pour spouts has been less than satisfactory. This is especially so with the advent of the use of this type carton for such pourable products as cooking oil, etc., where the product is more demanding on the integrity of the bottom sealing of the carton.

SUMMARY OF PRESENT INVENTION

In accordance with one aspect of the present invention, there is provided a pressure pad designed to be releasably mounted on the outboard end of a mandrel over which there is positioned a partially erected tubular carton of the gable top variety. Such carton includes a "non-handed" sealing fin on the bottom thereof and a pour spout on one top panel of the carton. When so positioned on the mandrel, the partially erected carton is in position for forming a closure of the bottom end of the carton preparatory to filling and selling of the carton. The pad is releasably mounted on the outboard end of the mandrel in a manner such that the pad may be rotated 180 degrees for use on first and second side-by-side carton-forming production lines which share like apparatus. In the dual production lines, the carton blanks move forward in the same lineal direction. The blank employed includes an opening in a top panel thereof for the receipt therein of a fitment. Insertion of the fitment dictates that the opening be disposed outboard of the production line. To this end, the blanks fed into the second line must be oriented 180 degrees from the orientation of the blanks being fed into the first line so that the fitment opening of the blanks fed to the second line are properly disposed on the outboard side of the second production line. Desirably, the two lines, for economic reasons, utilize as many common elements of apparatus as possible. To this end, one major consideration is the sealing of the infolded panels which close the bottom end of the erected carton inasmuch as reorientation of the blanks by 180 degrees presents the seal locations for the infolded blanks 180 degrees from the orientation of the same seal locations for those cartons moving along the first production line.

In the present invention, there is provided a pressure pad for use in sealing the bottom of a carton wherein the carton includes a "non-handed" elongated sealing fin as a part of the components from which the bottom of the carton is formed. One embodiment of a blank for producing a "non-handed" erected carton is depicted in FIG. 1. This blank includes lateral sides, a top end including a major panel for receiving a fitment thereon, major and minor bottom panels, and fin panels suitable for infolding to define a bottom closure for the erected carton.

The pressure pad of the present invention includes a multiplicity of emphasized pressure areas strategically distributed over a flat top surface of the pad. These emphasized pressure areas accommodate the layering of the "non-handed" sealing fin type carton bottom. They also accommodate the size, proportion and physical location of the bottom infolded gussets, the major panels and fin areas. This is to reduce the potential for forming machine induced stress cracks in the polymer coated paperboard carton material which defines a bottom closure of the carton. These emphasized pressure areas are developed through identification of those locations about that surface of the pressure pad which engage the partially infolded bottom panels and flaps prior to and preferably during the heat sealing of the infolded panels, tabs and flaps into a bottom closure for the carton. These pressure areas, developed through the pressure pad of the present invention, function in selected areas of the bottom of the carton, to squeeze the infolded overlying and/or folded edges of bottom panels, tabs and flaps together to enhance their proximity to one another. Importantly, these pressure areas function to enhance the sealing of the panels and flaps to one another at crucial locations over the bottom of the carton. These means overcome the tendency of leakage at such crucial locations.

In a preferred embodiment, the present pressure pad includes a central pinnacle, preferably of multiple parts, at least one of which is adapted for selective adjustment of its projection height above the top surface of the pad.

DETAILED DESCRIPTION OF INVENTION

Figure 1:
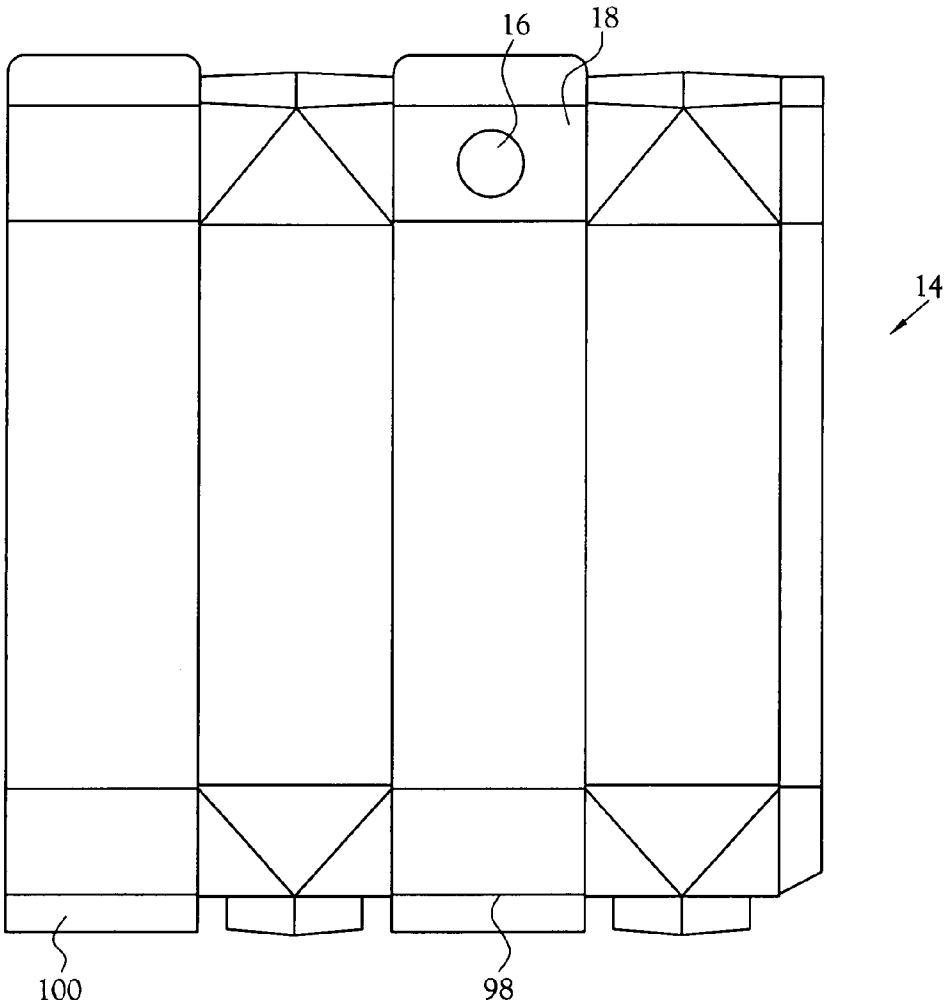
FIG. 1 is a plan view of a blank useful in the formation of a carton of the gable top variety and having an opening for receipt of a pour spout.
Figure 6:
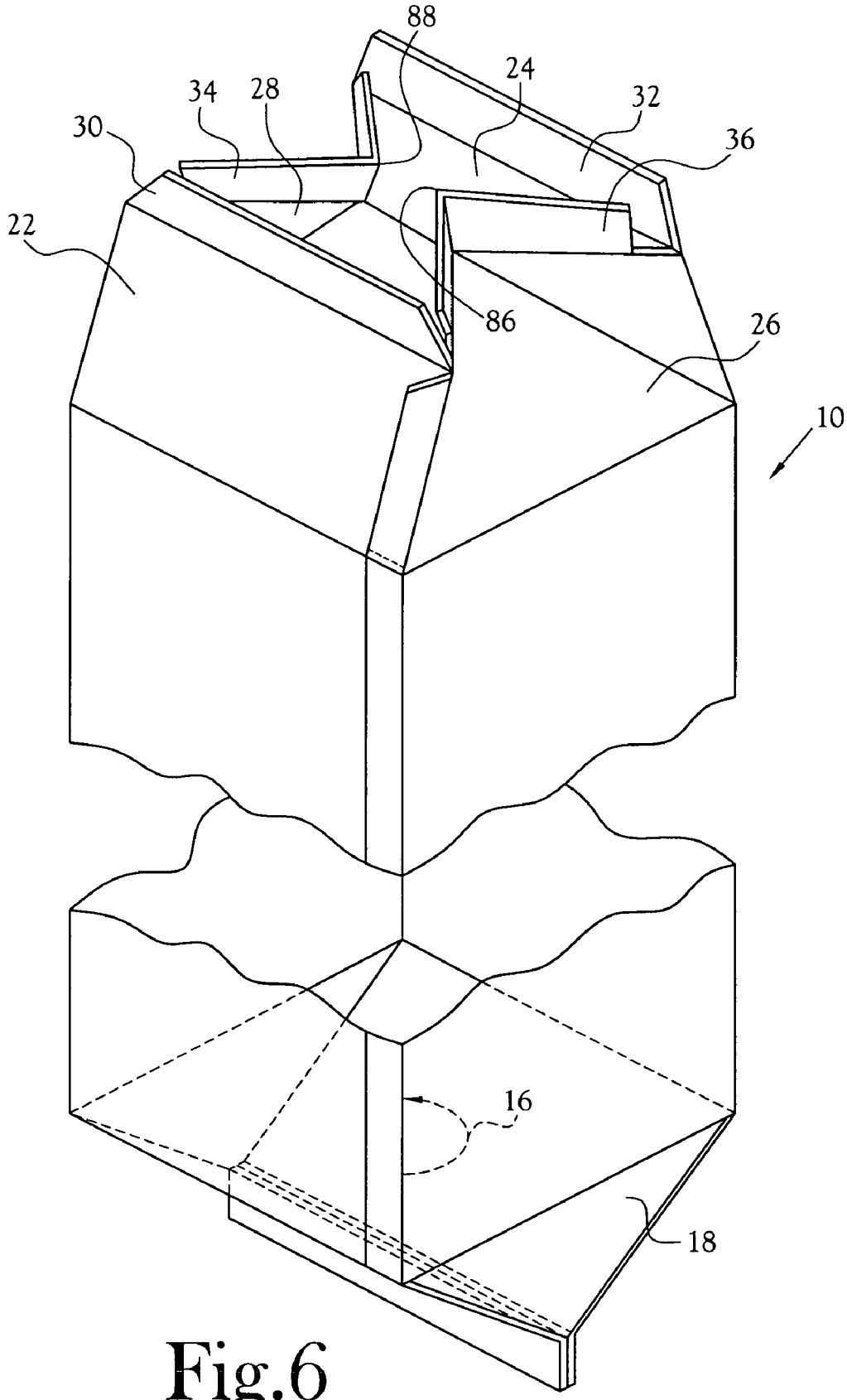
FIG. 6 is a representation of a gable-type carton partially erected from a blank as depicted in FIG. 1.

In accordance with one aspect of the present invention, and referring to FIGS. 2-5, there is provided a pressure pad 10 which is useful in a form, fill and seal machine having multiple side-by-side production lines wherein gable-type cartons 12 (FIG. 6) are erected from blanks 14 (FIG. 1). These blanks are provided with respective openings 16 in one of their respective major top panels 18 for the receipt of a pour spout (fitment). Following closure of the bottom of the carton, it is filled and sealed. The cartons of the side-by-side production line move in the same direction of progression along the substantially parallel production lines. A system of this type is depicted in U.S. Pat. No. 6,599,225.

In the depicted embodiment of the pressure pad of the present invention, the pad 10 comprises a metal plate, commonly of about 0.688 inch thick and about 4 inches square adapted to be releasably attached as by bolts 19 (typical) to the outboard end of a mandrel (not shown) as is well known in the art. The pad is provided with a flat top surface 20 which is geometrically altered to provide differing sealing pressures at selected locations over the area of the infolded, but unsealed, major panels 22 and 24, respectively, first and second gusset panels 26 and 28, respectively, first and second seal fin flaps 30 and 32, respectively, and first and second tabs 34 and 36, respectively which define the closed bottom of each carton. In the embodiment depicted in FIG. 2, the pad includes a first transverse centerplane 38 and a second transverse centerplane 40, these planes intersecting one another at the center 42 of the pad.

More specifically, in the depicted embodiment, the pressure pad includes a novel pinnacle extending upwardly from the top flat surface of the pad. In the depicted embodiment this pinnacle is in multiple parts. A first part 46 comprises a pin 48 (See FIGS. 2-5) of substantially cylindrical geometry having a bottom surface 50, a top surface 52 and a patterned raised projection 54 extending upwardly from the top surface of the pin. This patterned projection is generally in the form of a common electrical power pole having a central post 56 and multiple cross arms 58 and 60. This pin is slidably disposed with a bore 62 leading through the thickness of the pad. This bore is internally threaded 66 adjacent its bottom end 68 to receive therein an externally threaded plug 70 having its outboard end 72 disposed in position to engage the bottom surface 50 of the pin and establish the extent to which the patterned raised projection on the top surface of the pin will extend above the top surface of the pad. A further part of the pinnacle comprises a further patterned raised projection 74 which extends upwardly away from the top surface of the pad. The pattern of this further part also resembles a common electrical power pole having a central post 76 and first and second cross arms 78 and 80, respectively extending laterally of the post at spaced apart locations along the length of the post. The height of this further part of the pinnacle is fixed. The base 82 of the post 76 abuts the outer perimeter 84 of the pin and extends substantially therefrom in alignment with the second transverse centerplane of the pad, such second transverse centerplane being oriented perpendicular to the first transverse centerplane and intersecting the midpoint of the first transverse centerplane. In this embodiment, the cross arms of the first part of the pinnacle are substantially parallel to one another and are oriented substantially perpendicular to longitudinal dimension of their respective post. These arms of the first part of the pinnacle also are substantially parallel to the cross arms of the second part of the pinnacle. This pinnacle thus is located proximate the center 42 of the top flat surface of the pad where it overlies the adjacent first and second apices 86 and 88, respectively, of the two side gussets formed as a part of the infolding of the major and minor bottom panels and which define a major portion of the closed bottom of the carton. It is in the vicinity of these apices that there is the greater number of overlying layers of the carton material, where there are some of the most stressful folds of the carton material and consequently a greater tendency for the carton material to crack, crease, etc., hence the greater tendency for leakage to occur in this area of the bottom of the carton. It is also in this area that heavier coatings of heat sealing material such as polyethylene on the carton material are undesirable due to their addition to the thickness of the carton material in this area. Further, there is difficulty in these areas in establishing adequate compaction of the overlying layers of carton material for heat sealing to take place without physical deterioration of the paperboard material of which the carton is formed. In this regard, the present inventor has found that broad-based application of a squeezing force against the infolded bottom panels and the mandrel on which the tubular carton is carried in the area of the apices of the gussets commonly requires inordinately large pressure values to force the overlying layers into good contact with one another in the course of heat sealing the layers to one another. Such overall pressure also tends to contribute even further to the disintegration of the carton material in the gusset areas. To the contrary, the multiple part design of the pinnacle of the present invention has been found to generate lines of pressure along each of the cross arms, and along the length dimension of the post elements of the multi-part pinnacle design which enhance the development of multiple spaced apart compressed areas in the area of the apices of the gussets. Upon heat sealing, these compressed areas develop in-line separated dams of compressed heat seals, thereby providing for multiple relatively small, but highly effective, areas of heat sealing of the overlying layers of carton material within the apical areas of the gussets. As is evident, less overall pressure need be applied to the pad itself in order to obtain the desired enhanced pressure per unit of area at the locations of the elements of the pinnacle. Moreover, the adjustability of the height of the pin employing the threaded plug 70 which forms a first part of the pinnacle permits the selection of more or less pressure being applied to the underlying apical areas of the gusset panels of the carton bottom and the four-layered seal fin, as is needed for a given carton material or design.

Notably, the post elements of the two parts of the pinnacle extend laterally from the first transverse centerplane of the pad to overlie an underlying four-layered seal fin in a direction substantially perpendicular to the length dimension of the underlying seal fin. This linear pressure area requires less overall pad pressure to develop an enhanced series of pressurized areas leading outwardly from the pin, thereby enhancing the effect of the cross arm seals.

The seal fin of the carton is infolded to overlie a selected one of the major side panels of the bottom closure of the carton. Thus, the seal fin is disposed substantially centrally of the bottom and is oriented along the first transverse centerplane of the pad, hence intersects the two post elements of the pinnacle so that the mid portion of the seal fin also overlies the apices of the gussets, creating an exceptionally difficult area to effectively seal. Once properly sealed defines is a strong central area of the outer surface of the bottom of the carton where major wear and tear is experienced by the bottom of the carton during shipping and storage. In the present invention, irrespective of what "hand" orientation of the fin seal is chosen, that area of the fin seal which overlies the apices of the gussets also underlies the raised areas of the pinnacle of the present pad. More specifically, the disposition of the crosses in overlying relationship to the gussets apices provides for concomitant application of pressure for effecting enhanced sealing of the fin seal as a form of "secondary" covering in the vicinity of the gussets apices, thereby further enhancing the usefulness of the present pressure pad in the effective sealing of the multiple infolded components of the bottom closure of the carton.

Moreover, in the depicted embodiment of the present invention, commencing at the first transverse centerplane of the pad and extending laterally therefrom approximately equidistant from each side of such centerplane on the top flat surface of the pad and toward the second and third sides of the pad, there is provided a rectangular projection "A" which projects from the top surface of the pad by a distance less than the projection distance of the pinnacle "AA". This rectangular projection is flat and projects away from the top surface of the pad by a constant value which is less than the projection distance of the pinnacle. A first portion 90 of this rectangular projection is disposed along a first side 92 of the first transverse centerplane of the pad with the second portion 94 being disposed along the second, and opposite, side 96 of the first transverse centerplane of the pad.

The first portion 90 of this flat rectangular projection "A" is disposed adjacent the pinnacle and in use, overlies the fin seal and underlying gussets when the pad engages the infolded bottom panels and flaps and fin seal in the sealing of the bottom of an erected carton. This first portion of the rectangular projection includes an area "B" immediately adjacent the second part of the pinnacle. The height of this area "B" above the top surface of the pad is of lesser height than the pinnacle and aids the elements of the pinnacle in performing their enhancing sealing compression of the underlying gussets by providing an area into which a portion of the mass of infolded carton material (e.g., paperboard) may be forced as compression sealing takes place. In similar manner, there are provided essentially identical second and third areas "H" laterally of the pinnacle and which also are of lesser height than the pinnacle, also allowing for spread of the carton material away from the pinnacle-enhanced sealing pressure areas as needed.

The second portion "A" of the flat rectangular projection which is disposed alongside the second side 96 of the first transverse centerplane of the pad is of a height lesser than the height of the pinnacle, but of a greater height than the area "B" associated with the opposite portion 94 of the flat rectangular projection. This second portion, in use, overlies and aids in positioning of the multiple layers of carton material in the central area of the carton bottom and in holding the aligned infolded panels in their desired position for sealing.

Figure 2:
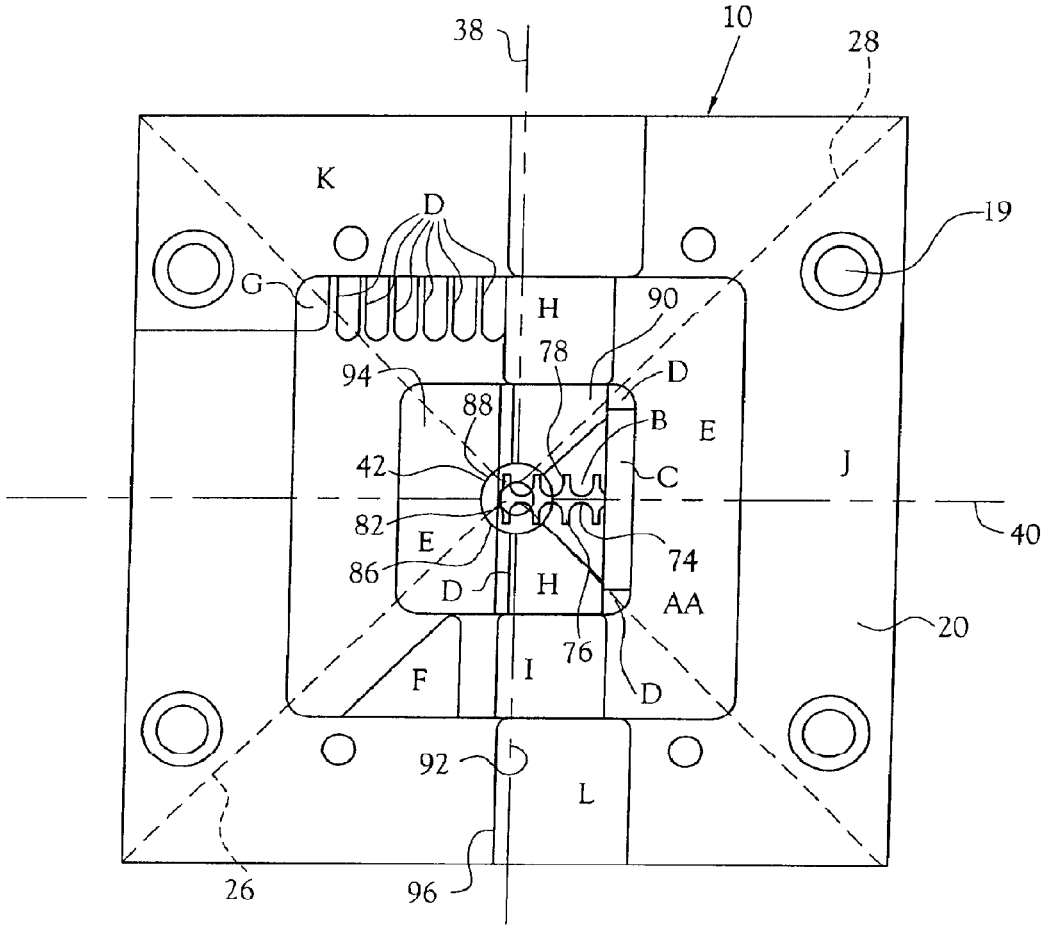
FIG. 2 is a top plan view of a pressure pad embodying various of the features of the present invention.
Figure 3:
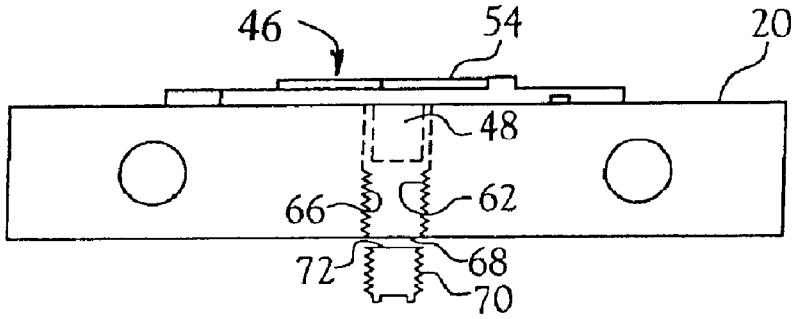
FIG. 3. is a side elevation view of the pad depicted in FIG. 2.
Figure 4:
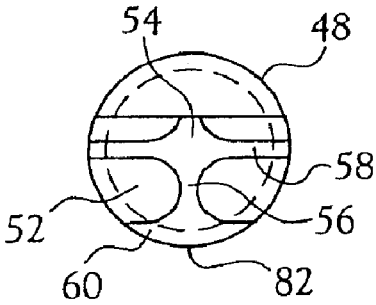
FIG. 4 is a top plan view of a pin adapted to be mounted substantially centrally of the pressure pad depicted in FIG. 2.
Figure 5:
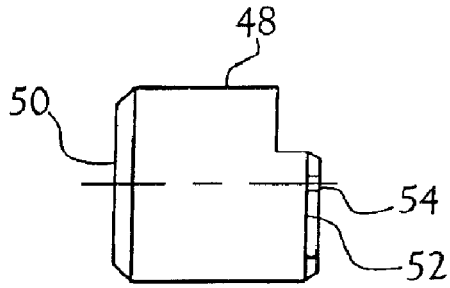
FIG. 5 is a side view of the pin depicted in FIG. 3.

With reference to FIG. 2, it will be noted that the depicted pressure pad includes an further rectangular area "E" which is centered with respect to the center point of the top surface of the pad. In the depicted embodiment, this second rectangular area surrounds the more central first flat rectangular area "A" and includes various projections from the top surface of the pad, all of which exhibit respective projection distances selected to enhance the sealing pressure at various locations about the area of the bottom of the carton both within and without the boundaries of the underlying gussets. For example, enhanced sealing pressure is provided for the fifth panel side seal by multiple projections "D".

In the embodiment of the pressure pad depicted in FIG. 2, the various projections are identified by alpha designations which are indicative of their respective projection heights about the top flat surface of the pad. Specifically, "AA" designates the highest projection ie. the pinnacle; "A" the next highest; "B" the next highest and so on through "L" which designates the lowest projection distance. The selected heights of each projection is selected as a function of the thickness of the paperboard used as the carton material, the number of layers which overlie one another in the infolded bottom-forming panels, etc., all as is well known in the art. In one embodiment, by way of example, for a given carton, the highest projection "AA" may project above the top surface of the pad by about 0.016 inch and the next highest projection distance "A" may be about 0.014 inch As noted the orientation of the pinnacle posts and cross arms adjacent to, but offset to one side of the centerplane of the pad is designed to apply enhanced sealing to the gussets and seal fin which underlie the pinnacle. This feature of the present invention makes possible the use of the present pressure pad in either of two side-by-side manufacturing lines for erecting, etc., gable top cartons having a pour spout feature associated with a top panel of the carton. In a "non-handed" carton bottom, the bottom seal fin is developed when the outboard flaps 30 and 32 of the two major panels and the tabs 34 and 36 of the gussets panels are infolded into overlying relationship to one another. As seen in FIGS. 1 and 2, this fin seal originates along fold lines 98 and 100 which, in the formed bottom, become oriented along the first transverse centerplane of the pad. In the process of closing the bottom of the carton, the flaps and tabs come together and define the four-layered seal fin which extends outwardly from the bottom of the carton in position to be bent either to the right or left of the carton bottom (as depicted in FIG. 1). This bottom seal fin is essentially identical to the top seal fin 102 depicted in FIG. 2. Existing apparatus for bending the seal fin is designed to bend the seal fin in only one direction, for example, toward that side of the carton which includes the pour spout opening as depicted in the several Figures. Such directional bending of the seal fin requires that the pressure pad be oriented such that the areas of specialized pressure application mate with the ends, edges and/or folds of the several infolded bottom panels. In the depicted embodiment, when the seal fin is bent toward that side of the carton having the pour spout opening, the pressure pad must assume the orientation whereby the specialized pressure application areas of the pad are also oriented toward that side of the carton having the pour spout. When utilizing dual side-by-side production lines, using the identical seal fin bending apparatus on the second production line results in the seal fin being bent away from that side of the carton having the pour spout. Thus, to accommodate this situation, the present pressure pad is designed such that it may merely be demounted from a mandrel, rotated 180 degrees about its center point (without changing its plane of orientation) and remounted on a mandrel so that the specialized pressure application areas are disposed in their required positions relative to the side, edges and/or folds of the infolded bottom panels, flaps and/or tab of the "flipped over" carton blank which is being fed into the second production line. This mandrel and the rotated pad may then be used in such second production line.

Whereas the present invention at times has been described employing specific terms, it will be recognized by one skilled in the art that various equivalents are available for various of the elements of the invention. Accordingly, the invention is intended to be limited only by the Claims appended hereto.

What is claimed is:

1. A pressure pad useful in the closing the bottom of a partially erected tubular carton of a heat sealable paperboard laminate blank held on a mandrel or the like wherein the bottom is formed from a plurality of infolded panels, flaps and/or tabs defining dual gussets having their apices disposed adjacent and facing one another and defining a gusseted bottom of the carton comprising:

a rigid pad of substantially rectangular flat top surface having a first transverse centerplane and being sculpted with multiple projections projected from said top surface at varying relative distances in position to engage one or more of the infolded panels flaps and/or tabs of the gusseted bottom of the carton and apply selectively enhanced sealing pressure against the infolded panels, flaps and/or tabs and force the panels, flaps and/or tabs against the mandrel in position for heat sealing of the infolded panels, flaps and/or tabs to define a closed bottom of the carton, a pinnacle projection defined substantially centrally of said top surface of the pad, said pinnacle including a central pin embedded within the top surface of the pad and having a top surface, said pin being disposed in position to engage the infolded panels, flaps and/or tabs in the adjacent apices of underlying gussets, said top surface of said pin including at least a central post element and at least one cross arm intersecting said central post element between its opposite ends.

2. The pressure pad of claim 1 wherein said pin is slidably disposed within pad whereby said top surface of said pin may be positioned at a selected height from said top surface of said pad.

3. The pressure pad of claim 1 wherein said pinnacle includes at least first and second parts, said first part comprising said pin and said second part comprising a projection disposed adjacent said pin, said second part including a central post member having a base end and an outboard end and at least one cross arm intersecting said central post member at a location along the length of said central post member between said base and said outboard ends thereof.

4. The pressure pad of claim 3 wherein said central post member and said at least one cross arm project from said flat top surface of said pad by equal distances.

5. The pressure pad of claim 3 and including means for selectively adjusting the height of said top surface of said pin above said top surface of said pad.

6. The pressure pad of claim 1 and including at least one further projection extending from said flat top surface of said pad at a location spaced apart from said pinnacle, wherein the projection distance of said pinnacle is greater than the projection distance of said at least one further projection from said flat top surface of said pad.

7. The pressure pad of claim 6 and including a plurality of further projections extending from said flat top surface of said pad, the projection distance of each such further projection from said flat top surface of said pad being less than the projection distance of said pinnacle from said flat top surface of said pad.

8. The pressure pad of claim 1 and including a generally flat rectangular area extending from said flat top surface of said pad by a projection distance less than the projection distance of said pinnacle, said platform being generally rectangular in plan view and substantially equidistantly extending laterally of said longitudinal centerplane of said pad at a location between said gussets.

9. The pressure pad of claim 8 wherein that portion of said platform which extends laterally of the longitudinal centerplane of said pad in the direction of said pinnacle includes at least one depression disposed adjacent to and bounding each of the opposite sides of said pinnacle.

* * * * *